US006726302B2

(12) United States Patent
Yamada

(10) Patent No.: US 6,726,302 B2
(45) **Date of Patent: *Apr. 27, 2004**

(54) PRINTING APPARATUS AND TEST PATTERN PRINTING METHOD

(75) Inventor: Kaneji Yamada, Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/322,028

(22) Filed: May 28, 1999

(65) Prior Publication Data

US 2003/0085940 A1 May 8, 2003

(30) Foreign Application Priority Data

May 29, 1998 (JP) ..... 10/149365
May 24, 1999 (JP) ..... 11/143923

(51) Int. Cl.[7] ..... B41J 29/393
(52) U.S. Cl. ..... 347/19
(58) Field of Search ..... 347/5, 9, 10, 12, 347/15, 19, 37, 40, 41, 43; 358/502, 504; 400/74

(56) References Cited

U.S. PATENT DOCUMENTS

| | | | | | |
|---|---|---|---|---|---|
| 4,198,642 | A | * | 4/1980 | Gamblin | 347/41 |
| 4,313,124 | A | | 1/1982 | Hara | 346/140 |
| 4,345,262 | A | | 8/1982 | Shirato et al. | 346/140 |
| 4,449,052 | A | * | 5/1984 | Krieg | 250/568 |
| 4,459,600 | A | | 7/1984 | Sato et al. | 346/140 |
| 4,463,359 | A | | 7/1984 | Ayata et al. | 346/1.1 |
| 4,558,333 | A | | 12/1985 | Sugitani et al. | 346/140 |
| 4,723,129 | A | | 2/1988 | Endo et al. | 346/1.1 |
| 4,740,796 | A | | 4/1988 | Endo et al. | 346/1.1 |
| 5,204,736 | A | * | 4/1993 | Abe | 358/500 |
| 5,373,368 | A | * | 12/1994 | Taniguro | 358/296 |
| 5,384,859 | A | * | 1/1995 | Bolza-Schunemann et al. | 382/112 |
| 5,387,976 | A | * | 2/1995 | Lesniak | 356/379 |
| 5,519,419 | A | * | 5/1996 | Stephany et al. | 347/19 |
| 5,600,351 | A | * | 2/1997 | Holstun et al. | 347/40 |
| 5,689,289 | A | * | 11/1997 | Watanabe et al. | 347/7 |
| 5,781,206 | A | * | 7/1998 | Edge | 347/19 |
| 5,797,690 | A | * | 8/1998 | Iwamura et al. | 400/124.01 |
| 5,923,345 | A | * | 7/1999 | Imai | 347/11 |
| 6,034,711 | A | * | 3/2000 | Trask et al. | 347/240 |
| 6,076,915 | A | * | 6/2000 | Gast et al. | 347/19 |
| 6,082,911 | A | * | 7/2000 | Murakami | 400/74 |

FOREIGN PATENT DOCUMENTS

| | | | | |
|---|---|---|---|---|
| EP | 533 486 A2 | * | 3/1993 | B41J/2/51 |
| JP | 54-56847 | | 5/1979 | |
| JP | 59-123670 | | 7/1984 | |
| JP | 59-138461 | | 8/1984 | |
| JP | 60-71260 | | 4/1985 | |
| JP | 6-78019 | | 10/1994 | |
| JP | 9-66650 | | 3/1997 | |
| JP | 409066650 A | * | 3/1997 | B41J/29/46 |

* cited by examiner

*Primary Examiner*—Stephen D. Meier
*Assistant Examiner*—Blaise Mouttet
(74) *Attorney, Agent, or Firm*—Fitzpatrick, Cella, Harper & Scinto

(57) ABSTRACT

A plurality of dot pattern formation is performed for each of a plurality of print elements. By overlaying or contacting a plurality of dots printed by the plurality of formation, a density value of a dot pattern formed on a printing medium is increased, and a test pattern whose area is enlarged is formed.

36 Claims, 14 Drawing Sheets

PRINTING APPARATUS AND TEST PATTERN PRINTING METHOD

This application is based on patent application Nos. 149365/1998 filed on May 29, 1998 in Japan and 143923/1999 filed on May 24, 1999 in Japan, the content of which is incorporated hereinto by reference.

BACKGROUND OF THE INVENTION

1. Field of the Invention

The present invention relates to a printing apparatus providing a function of printing a test pattern for the purpose of inspecting a printing state of each of a plurality of print elements composing a print head, and a printing method of this test pattern.

2. Description of the Prior Art

Up to now, in a printing apparatus such as an ink jet printer that uses a print head having a plurality of ink ejection openings as a print element, an ejection failure such as clogging of the ejection opening may arise due to bubbles remaining inside the ejection opening or adhesion of ink drops and dust near the ejection opening during a printing operation. Therefore, it is desirable to periodically inspect an ejection state of the ejection opening so as to always maintain the optimum ejection state. In a conventional inspection method, it is common to print a certain test pattern and decide whether or not an ejection failure exists by the print result.

Furthermore, if the ejection failure is found by means of such an inspection, the process of removing the cause of the ink ejection failure is performed by performing recovery processing such as a preliminary ejection process and a suction recovery process.

An example of a test pattern printing method is discussed in Japanese Patent Publication No. 6-78019 (1994). This method comprises the following steps. A horizontal line having a certain width is printed by means of an ejection opening that is a most upper position in order of arrangement within print a head, then a vertical line is printed by means of all the ejection openings of the head. Thereafter, in a similar fashion, a horizontal line having a certain length is printed by means of an ejection opening using the second ejection opening from the most upper one, and then, a vertical line is printed by using all the ejection openings. Thus, an ejection opening, which prints a horizontal line is shifted, every ejection opening so that a stepped test pattern is printed. Then, if a part of this test pattern lacks, it can be determined which ejection opening corresponding to the part that has failed during ejection. Nevertheless, if this test pattern is printed in a color with comparatively low visibility such as yellow, it is difficult to clearly separate a part, which is correctly printed, from a ground color of a printing medium such as paper. Therefore, if a defective part exists in this situation, it is difficult in some cases to identify a defective part.

To address this drawback, a test pattern printing method, mentioned in Japanese Patent Application Laid-Open No. 9-66650 (1997.) uses a stepped test pattern that is similar to the method described above, but enhances visibility in regard to a color with comparatively low visibility by overlaying another color on this color with comparatively low visibility at the same location. For example, by overlaying a cyan pattern on a yellow pattern, a green pattern is printed. In this case, if a part of the yellow pattern is defectively printed, the defective part is not printed in green, and hence is printed only in cyan.

Nevertheless, the test pattern printing method described above has the following problems.

Thus, some of recent printing apparatuses can improve a gradation in an image and decrease a granular texture by using low-concentration ink (i.e., low-density ink) in addition to normal-concentration ink and can perform printing in high resolution by down-sizing an ink drop ejected from an ejection opening so as to down-size a dot printed, according to a request for high-quality printing.

In this case, in a print head using the low-concentration ink, even if the test pattern described above is applied, it may be difficult to discriminate between a part correctly overlaid and a part where a dot-of the low-concentration ink lacks due to brightness of the low-concentration ink itself and the like. For example, if low concentration magenta (hereinafter, this is called light magenta) and low-concentration cyan (hereinafter, this is called light cyan) is overlaid, blue is formed. Nevertheless, since this blue is in low concentration, this color itself is also in low visibility. Therefore, difference between the part where, blue is formed and the part where only cyan is printed is not clear.

In addition, in the test pattern in case of small dot diameter, an effective area of each dot is small, and hence it sometimes may be not possible properly recognize whether the dot has been printed regardless of the color and concentration of ink.

Furthermore, if the test pattern is in secondary color (overlay of a plurality of color) printed in a dot with small diameter and a defective dot is present, it may be not possible to readily determine what color is lacking.

SUMMARY OF THE INVENTION

An object of the-present invention is to provide a test pattern printing method that can adequately decide a print failure even in an apparatus performing printing in small dot diameter or printing in low-concentration ink, and a printing apparatus performing printing with such a method.

In a first aspect of the present invention, there is provided a test pattern printing method in a printing apparatus for printing an image on a printing medium, using a print head where a plurality of print elements for forming dots on the printing medium are arranged, the method comprising the steps of:

main scanning step for scanning the print head along a main scanning direction;

pattern printing step for selectively driving a plurality of print elements of the print head, thereby to form dots and print a test pattern, wherein the pattern printing step forms the predetermined number of dots along the main scanning direction according to the selected print elements, and the density of dots formed by each print element is higher than the print density caused during image printing operation.

In a second aspect of the present invention, there is provided a test pattern printing method in a printing apparatus for printing an image on a printing medium, using a print head where a plurality of print heads thereby to form dots on the printing medium are arranged, the method comprising the steps of:

scanning step for scanning the printing head relatively to the printing medium in a direction different from the plurality of print elements; and test pattern printing for selectively driving the printing elements of the print head during scanning in the scanning step, thereby to print a test pattern, the test pattern printing step repeating the steps of: selecting predetermined print elements of the print head; and driving the selected print elements to form one or more lines along the scanning direction, thereby printing the test pattern, the lines being composed of a plurality 6f dots formed by the selected print elements, wherein the test pattern printing step is capable of printing a plurality of test patterns that differentiate a method of forming dots constituting the test patterns, and the plurality of test patterns are different from each other in density of a plurality of dots constituting one or more lines along the scanning direction, respectively.

In a third aspect, of the present invention, there is provided a printing apparatus having main scanning means for relatively scanning along a main scanning direction a printing head where a plurality of print elements for forming dots on a printing medium are arranged, and driving the print elements of the print head during scanning by the main scanning means, thereby to print an image on the printing medium, the printing apparatus comprising:

test pattern printing means for selectively driving print elements of the print head during print head scanning by the main scanning means, thereby to print a plurality of test patterns, wherein the test pattern includes one or more lines printed along the main scanning direction by driving a selected, predetermined print element from among a plurality of print elements of the print head, and the lines are composed of a plurality of dots formed by the thus selected print element, controlling means for controlling the density of a plurality of dots, wherein the dots constitutes the lines along the scanning direction of the test pattern, and the density is higher than the density caused during image printing.

In a fourth aspect of the present invention, there is provided a printing apparatus having main scanning means for relatively scanning along a main scanning direction a printing head where a plurality of print elements for forming dots on a printing medium are arranged, and driving print elements of the print head during scanning caused by the main scanning means, thereby to print an image on the printing medium, the printing apparatus comprising:

test pattern printing means for selectively driving print elements of the print head during print head scanning caused by the main scanning means, thereby to print a test pattern, wherein the test pattern includes one or more lines printed along the main scanning direction by driving one or more selected, predetermined print elements from among a plurality of-print elements of the print head, and the lines are composed of a plurality of dots formed by the thus selected print element, and controlling means making it possible to print a plurality of test patterns that differentiate a method of forming dots constituting a test pattern, wherein a plurality of test patterns are different from each other in the density of a plurality of dots constituting the lines along the scanning direction.

According to the above construction, a plurality of dots are formed by means of the same print element so that the plurality of dots are overlaid with or contacted to each other, and thus the density of a dot pattern is increased or the area of a dot pattern is increased, which are formed by the same print element, on a printing medium. Therefore, the visibility of an overall test pattern is enhanced, and the abnormality of a print element can be easily detected.

The above and other objects, effects, features and advantages of the present invention will become more apparent from the following description of embodiments thereof taken in conjunction with the accompanying drawings.

DESCRIPTION OF THE PREFERRED EMBODIMENTS

Embodiments to which a printing apparatus and a test pattern printing method of the present invention can be applied will be described below with reference to drawings.

Figure 1:
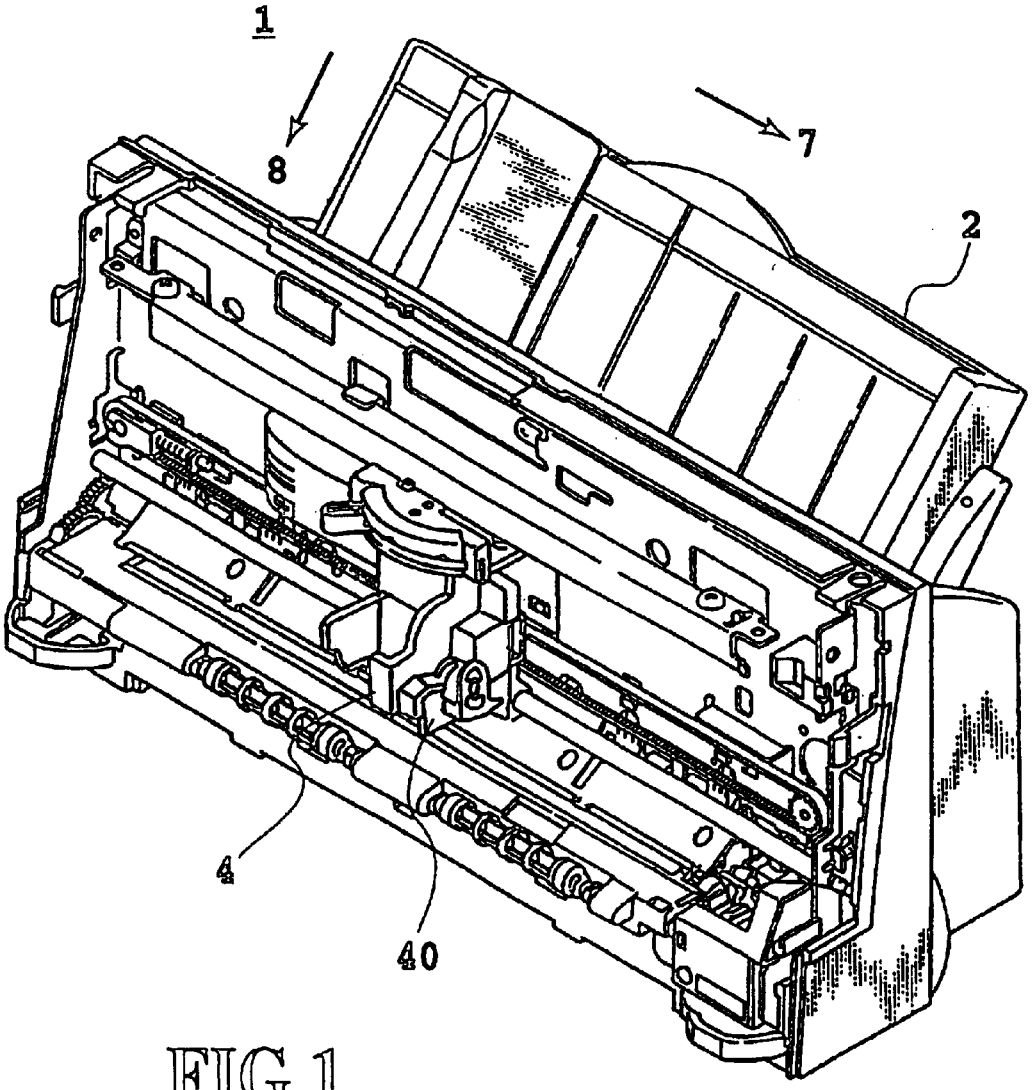
FIG. 1 is a perspective view showing an internal mechanism of a printing apparatus of the present 5 invention.

FIG. 1 is a perspective view showing an internal mechanism of an ink jet printer to which the printing apparatus and test pattern printing method of the present invention are applied.

Figure 2:
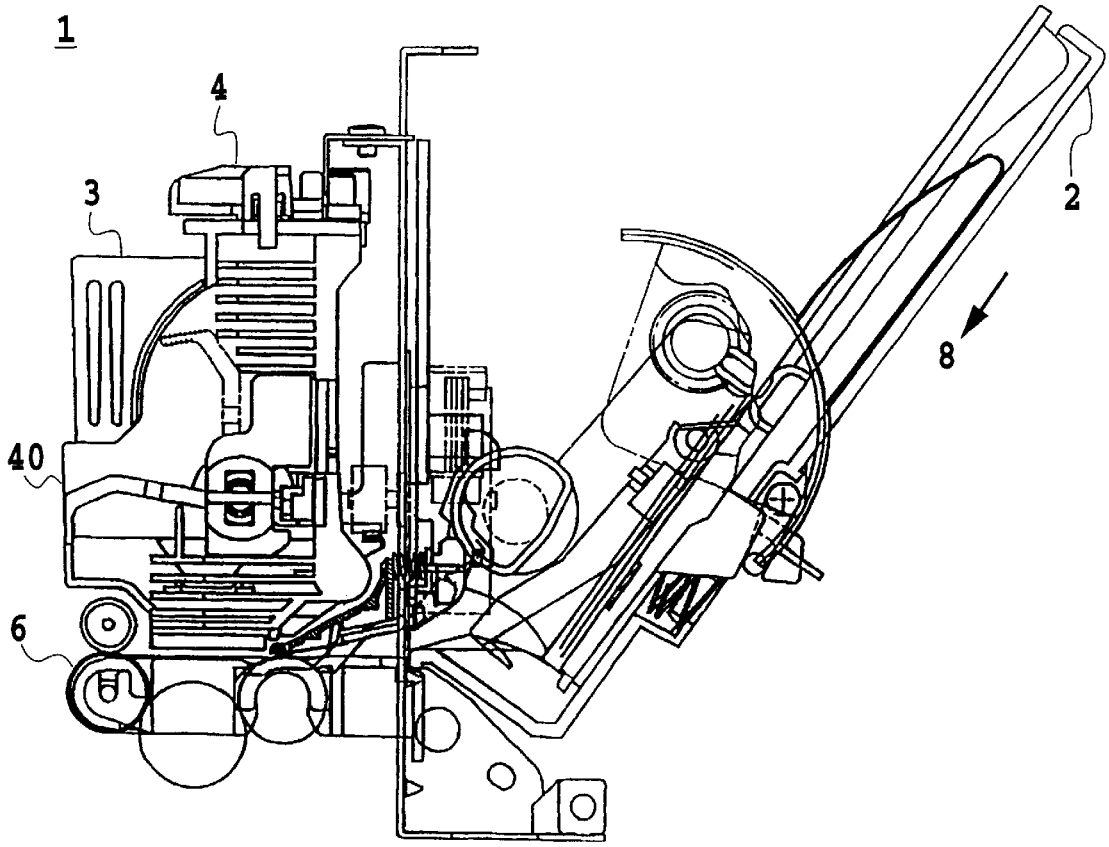
FIG. 2 is a side view of the printing apparatus of the present invention.

FIG. 2 is a side view of this ink jet printer.

The ink jet printer 1 comprises a paper supply unit 2 that stacks printing media (not shown) such as printing paper and supplies the printing medium at the time of printing, a print head 3 ejects ink drops necessary for forming an image on the printing medium, a carriage 40 holds print head 3, a carriage drive unit 4 moves carriage 40 in the main scanning direction (also called "primary scanning direction") shown by an arrow 7, a paper feed unit 5 moves the printing medium, which is printed, in the sub-scanning direction (also called "secondary scanning direction") shown by an arrow 8, and a paper ejection unit 6 outputs the paper, which is printed to a predetermined location.

Figure 3:
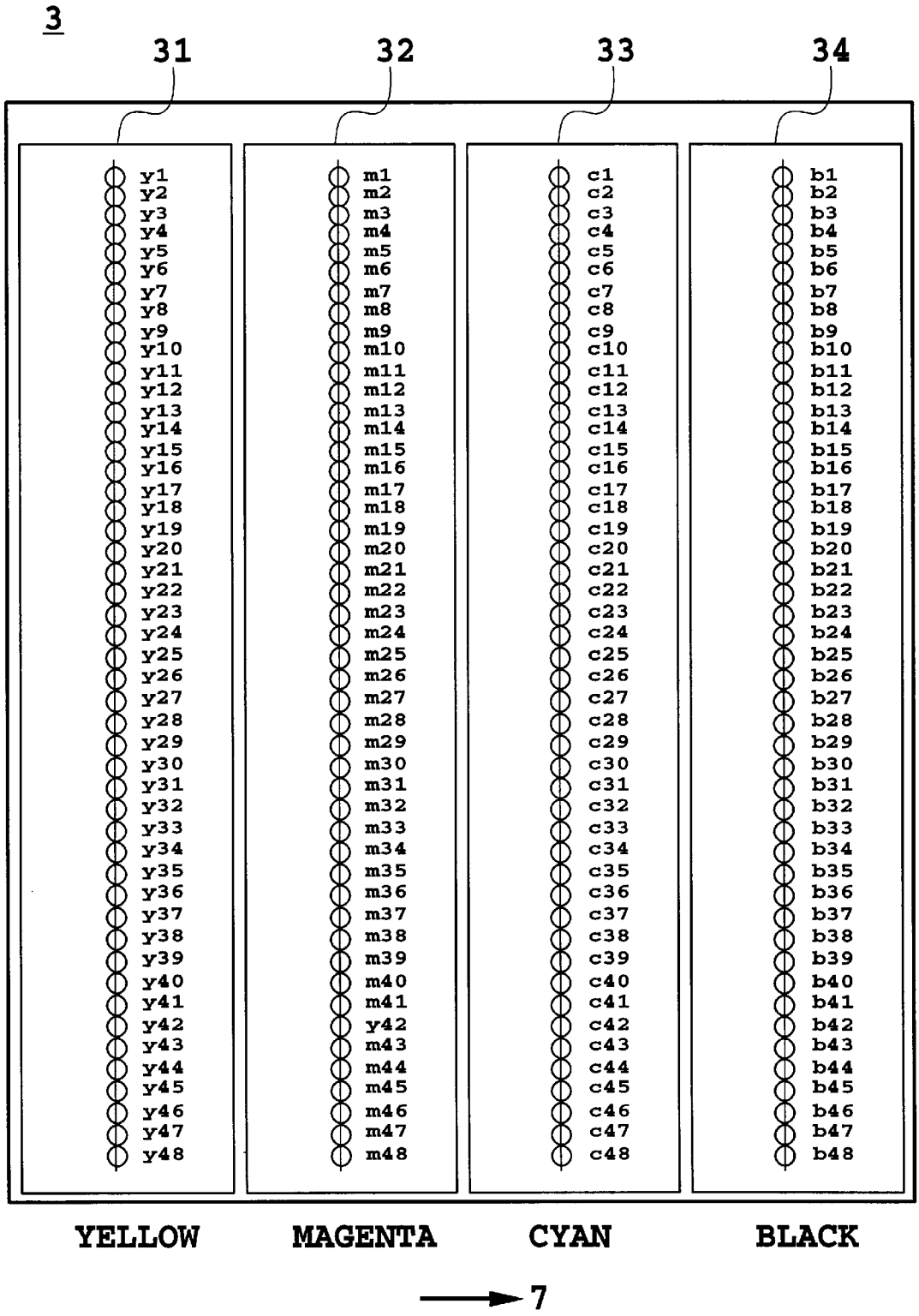
FIG. 3 is a drawing showing the inside of a print head.

FIG. 3 is a schematic front view of the print head 3.

In the print head 3, a Y head 31 ejecting yellow ink, an M head 32 ejecting magenta ink, a C head 33 ejecting cyan ink, and a K head 34 ejecting black ink are provided alongside in the main scanning direction shown by an arrow 7. In each of color heads 31 to 34, forty-eight ejection openings ejecting each ink are vertically provided in the main scanning direction. Each of these heads has electrothermal conversion elements corresponding to respective ejection openings, and ejects ink using thermal energy generated by these elements. In addition, here, numbers from 1 to 48 are assigned to ejection openings of each color head, which are shown in FIG. 3, in order of height, capital letters of respective colors, y, m, c, and b are attached before the numbers for distinction, and these are used for description.

In addition, in this embodiment, although forty-eight ejection openings are provided for every color, the present invention is not limited to this number and arrangement, but another number and other arrangements can be used. A desired image is formed by ejecting ink drops from the ejection openings, which are selected, and making the ink drops reach the printing medium by moving the print head 3, having such construction, by the carriage drive unit 4 in the main scanning direction. In addition, kinds of ink composing the print head 3 are not limited to four colors, that is, yellow, magenta, cyan, and black, but the construction of including other colors such as low-concentration ink can be used. In this case also, the test pattern printing method described later can be applied.

Next, this test pattern printing method of the present invention will be described below.

Embodiment 1

In this embodiment, a method for enhancing visibility by increasing density values of a dot through overlaying with a plurality of dots formed by the same ejection opening, among the test pattern printing methods of the present invention will be described. In addition, the following description relates to a test pattern for the Y head 31.

Figure 4:
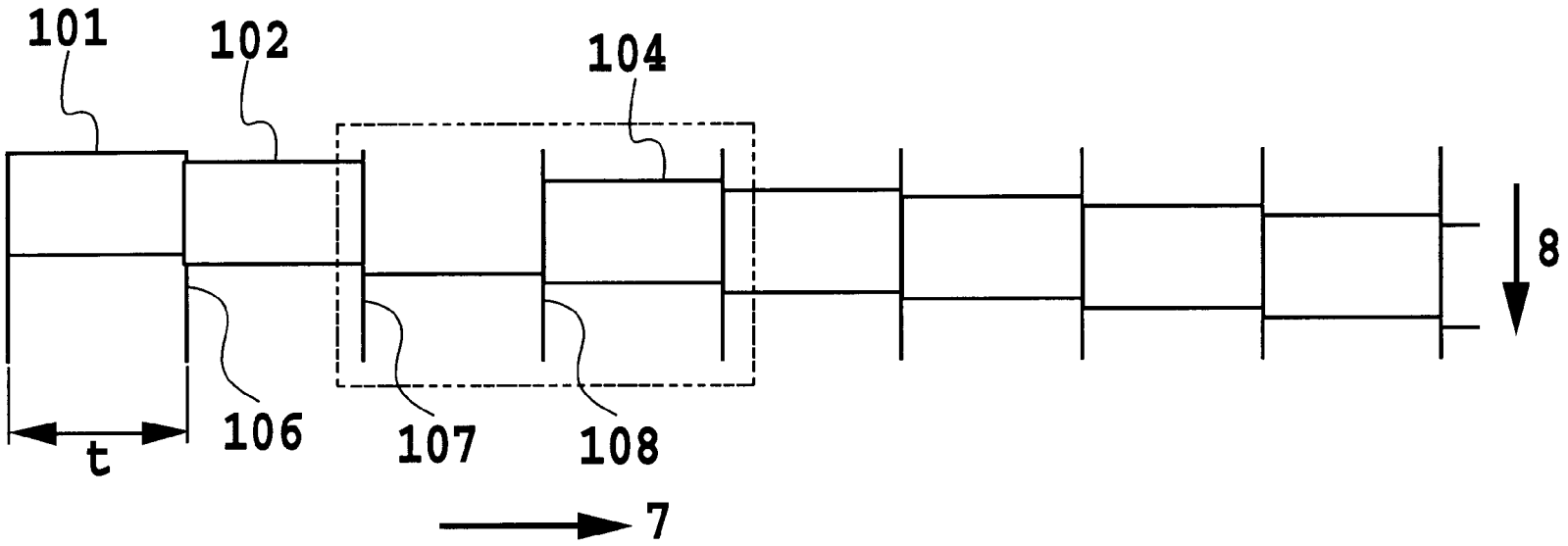
FIG. 4 is a drawing showing an example of test patterns.

As shown in FIG. 4, first, a horizontal line 101 is formed by ejecting an ink drop only from an ejection opening y1 while moving the print head 3 by certain width t in the main scanning direction shown in an arrow 7.

Figure 5:
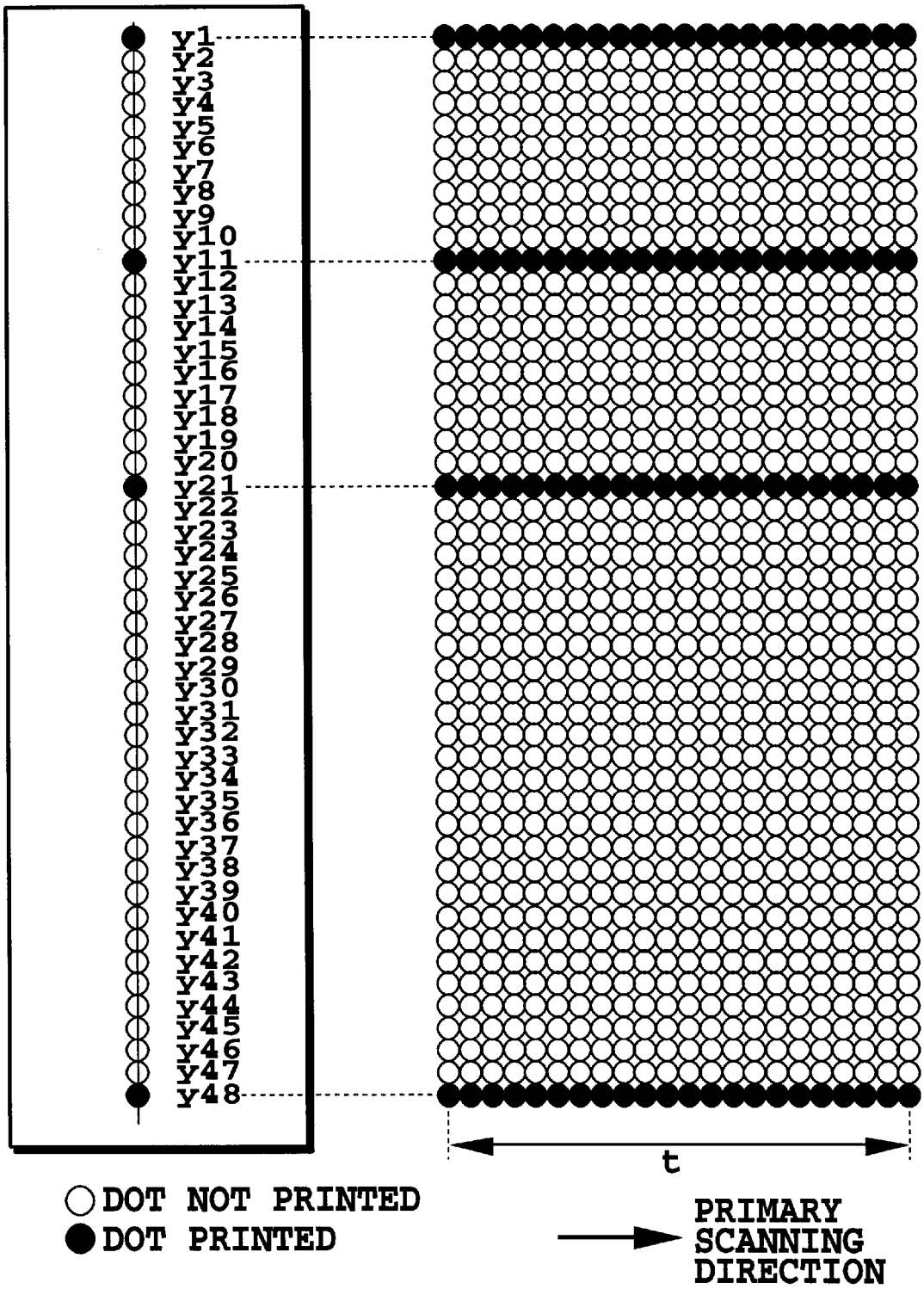
FIG. 5 is a drawing showing relationship between ejection openings and dots printed.

FIG. 5 is a drawing of enlarging the horizontal line 101 in FIG. 4.

Thus, the print head 3 forms the horizontal line 101 in width t by ejecting predetermined times from the ejection opening y1 in the main scanning direction.

Figure 6:
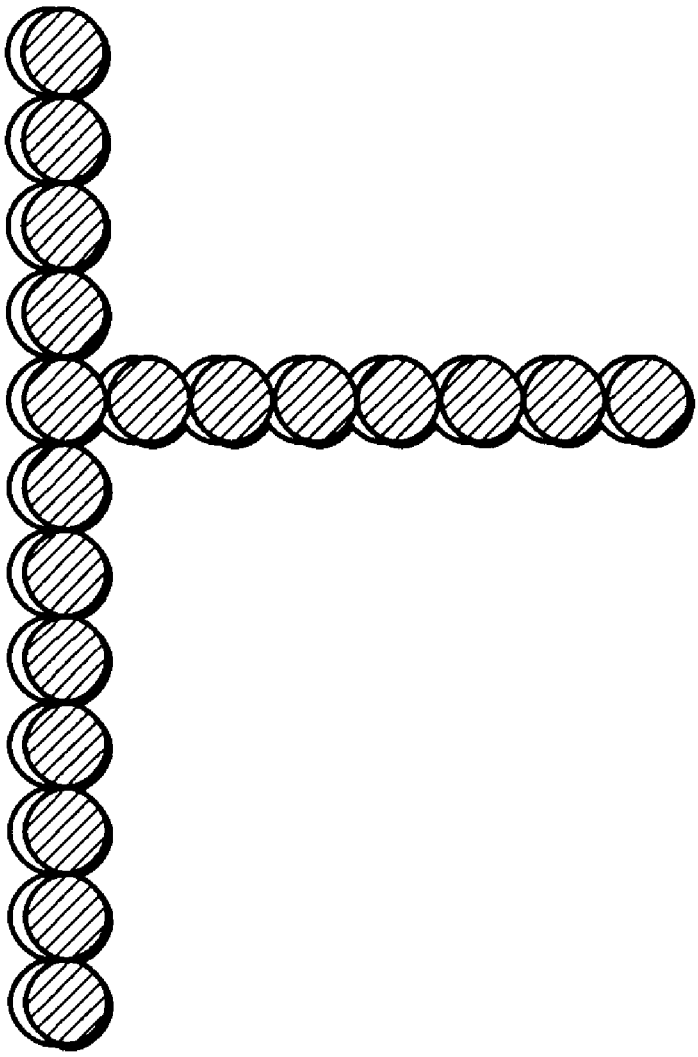
FIG. 6 is an enlarged drawing showing a test pattern at the time of overlaying dots.

Next, a vertical line 106 is formed by all the ejection openings y1 to y48 ejecting ink drops simultaneously. Subsequently, a horizontal line 102 is formed in a location, which is lower by an amount equivalent to one dot than the horizontal line 101, by ejecting ink drops from only the ejection opening y2 so as to print in width t in the main scanning direction. Next, a vertical line 107 is formed by ejecting ink drops from all the ejection openings y1 to y48 simultaneously. Hereinafter, similarly, a stepped test pattern, where a next horizontal line is lower by one dot than a present horizontal line, is formed by performing printing from the ejection openings from y3 to y48. Here, when a horizontal line and a subsequent vertical line are printed by the lowest ejection opening, the carriage 40 is returned to the initial print start position without feeding the paper in the sub-scanning direction shown by the arrow 8. Then, similar printing is performed in the same location again. By making ink drops reach the same positions through repeating such a series of operations, for example, twice, dots-overlaid are obtained. As a result of printing with such a method, print is dense and clear since each dot, and each horizontal line and each vertical line, which are aggregates of dots, are emphasized as shown in FIG. 6.

In addition, in the repeating of the printing operation described above, overlaying can be performed in reverse order from their printing when returning to the print start position. Nevertheless; print data processing in this method is complicated in comparison with that in the method described above, and hence the above-described method that has simple print data processing is preferable. In addition, a frequency of overlaying is not limited to twice, but it goes without saying that the frequency can be determined according to ink color or concentration.

Figure 7:
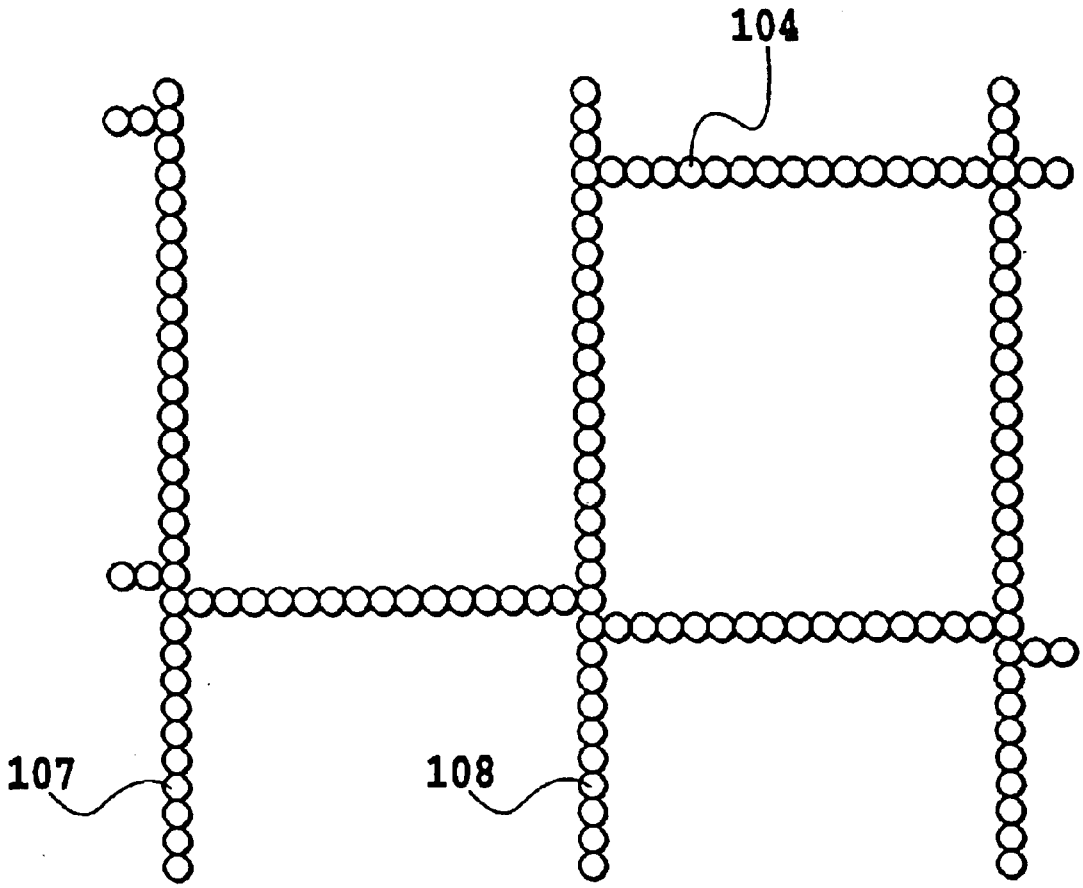
FIG. 7 is an enlarged drawing showing a dotted part of the test pattern in FIG. 4.

Here, it is assumed that such a state that a horizontal line between vertical lines 107 and 108 are to be printed at an upper portion similarly to horizontal lines 102 and 104. Horizontal lines 102 and 104 do not print, as shown in FIG. 4 and FIG. 7 and as an enlarged drawing of FIG. 4. In this case, since the horizontal line that should be formed by an ejection opening y3 is not printed, it is decided that the ejection opening y3 is failed in printing. Since this print result of each line is clearer than a conventional one, it is possible to easily find the lack of the horizontal line. In this manner, it is possible to enhance the visibility by increasing a density value of dots through overlaying the dots. This method is particularly effective for yellow and low-concentration ink.

In addition, this method is also effective for application to a test pattern in secondary color.

For example, in a test pattern for deciding abnormality by checking whether blue is correctly formed by overlaying light magenta and light cyan, by overlaying with the light cyan twice on the light magenta that is overlaid twice, it is possible to form blue denser than blue obtained by overlaying respective colors once. Therefore, since the visibility of the test pattern is enhanced and difference between a blue part and another part becomes clear, it is possible to easily identify an abnormal part. In addition, combination of overlaying can be twice-overlaid light magenta and twice-overlaid light cyan, or other combination.

Embodiment 2

Next, a test pattern printing method according to another embodiment of the present invention will be described, the method that enhances the visibility by enlarging effective areas of dots pattern through printing dots, which are formed by the same ejection opening, with contacting the dots.

Figure 8:
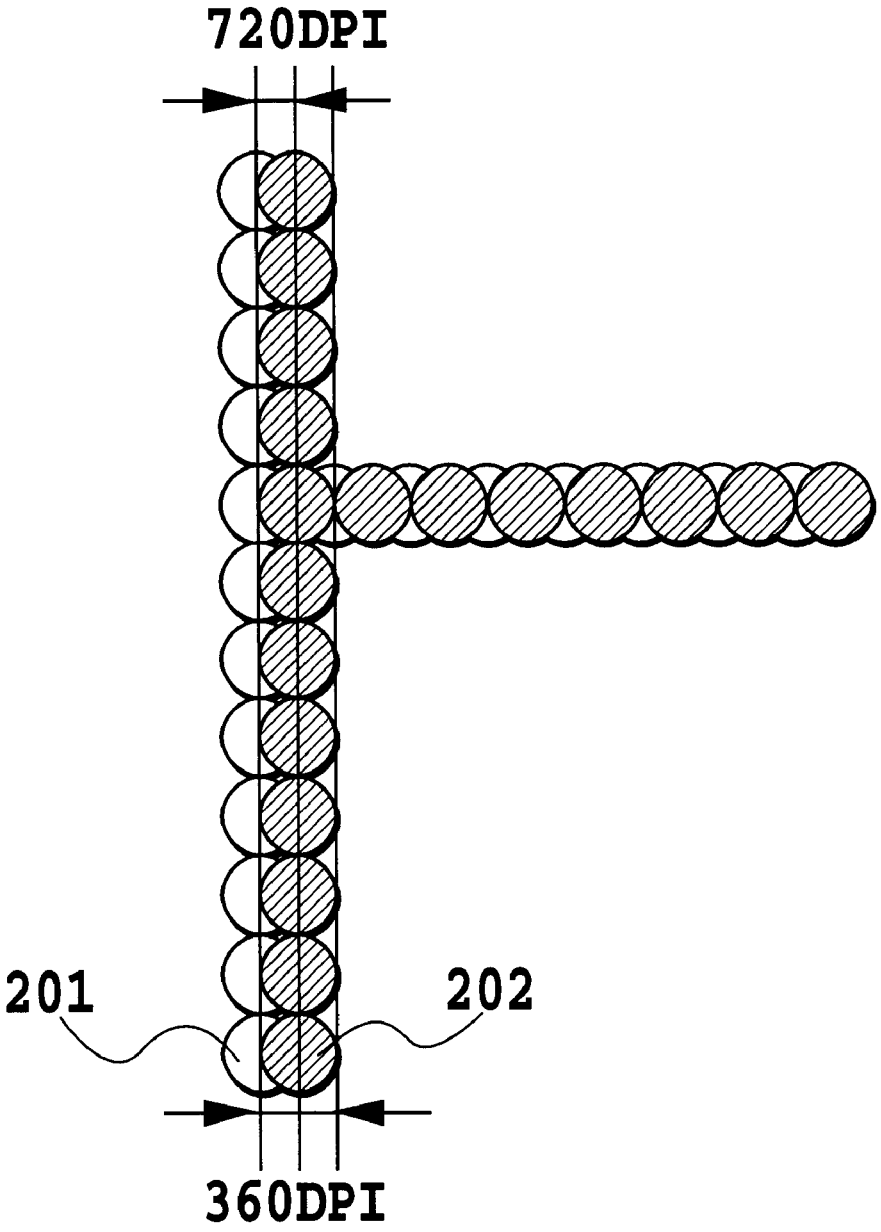
FIG. 8 is an enlarged drawing showing a test pattern where impact positions of dots are shifted in the main scanning direction.

FIG. 8 is an enlarged view of a part of a test pattern for forming a stepped pattern by lowering a horizontal line by one dot every ejection opening. In addition, in this embodiment, it is assumed that resolution is 360 dpi in the main scanning direction and 360 dpi in the sub-scanning direction.

Figure 9:
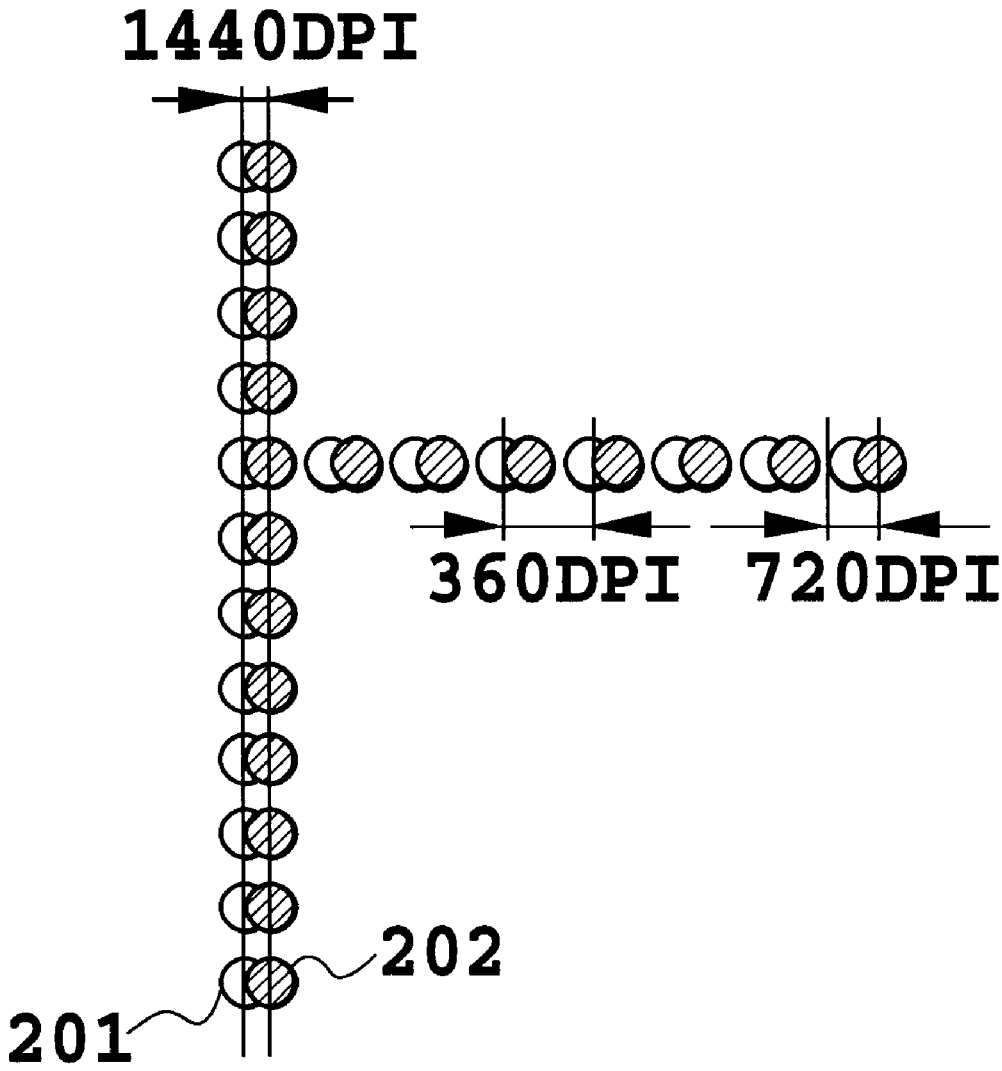
FIG. 9 is an enlarged drawing showing another example of test patterns where impact positions of dots are shifted in the main scanning direction.

In this embodiment, a drive frequency of the print head 3 normally forming one dot per one pixel is doubled, but scanning speed of the carriage is not changed. Owing to this, it is possible to print a vertical line 202 shown by hatched circles in the drawing at a location, shifted by 720 dpi in the main scanning direction, in next ejection timing to a vertical line 201 shown by white circles, which are formed in the first ejection timing, in the drawing. In this manner, by ejecting ink drops with doubling the drive frequency of a head, respective dots are overlaid with being shifted a little bit in the main scanning direction, that is, respective dots are printed with being contacted. As a result, an area in the main scanning direction becomes larger than that in the case of one dot per one pixel. In addition, if dots are overlaid according to the size of dots formed, the overlaid part forms an image denser than an image formed in once-printing, similarly to the above-described method for performing a plurality of printing at the same positions. In addition, setting of the drive frequency of the print head 3 can be arbitrarily performed according to dot size and the like. For example, as shown in FIG. 9, the drive frequency can be set at a frequency for printing a vertical line 202 with shifting the vertical line 202 by quantity, corresponding to 1440 dpi, from a vertical line 201.

In this manner, the method for performing printing with shifting an impact position of a dot by a predetermined interval in the main scanning direction by changing the drive frequency can form an image where dots are overlaid by a single shift of the print head 3 in the main scanning direction. Therefore, there is no operation of returning the carriage 40 to the print start position again after shifting the carriage 40 once in the main scanning direction as the example described above with reference to FIGS. 4 and 5, or moving the carriage 40 again in the same location with reversing the main scanning direction. Hence, it is possible to increase the throughput relating to test pattern printing in comparison with the former example.

According to the method of these embodiments, a plurality of dots formed by an identical ejection opening are printed so as to be partially overlaid, respectively, at the shifted positions each other along a main scanning direction. Therefore, an effective area of dots formed by each ejection opening can be increased, making it possible to improve dot visibility and judge an ejection failure. The method according to these embodiments is particularly effective in a printing head, the ejection quantity of which is reduced to enhance resolution. The less ejection quantity is, the smaller diameter of one dot is. According to these embodiments, the effective area of dots is increased by performing printing so that a plurality of dots are partially overlaid at the shifted positions each other, thereby making it possible to enhance dot visibility.

In the aforementioned embodiments, we describe a construction in which a driving frequency is increased without changing the scan speed in the main scanning direction of a carriage, thereby printing a plurality of dots at the shifted positions to each other along the main scanning direction. The present invention is applicable to a construction in which the scan speed in the main scanning direction of the carriage is reduced without changing the driving frequency, thereby printing a plurality of dots at the shifted positions to each other along the main scanning direction. In addition, a plurality of dots can be printed at the shifted positions to each other along the main scanning direction by properly changing the driving frequency of the printing head.

Further, the present invention according to the aforementioned embodiments is characterized by a construction in which a plurality of dots are printed at the shifted positions to each other along the main scanning direction. However, a pattern as shown in FIG. 8 may be printed by moving the printing head in the main scanning direction twice to perform printing. In a construction in which the pattern shown in FIG. 8 is printed by performing main scanning twice, it is sufficient that a pattern as shown in FIG. 4 is printed in a first movement in the main scanning direction, and a timing of the first printing and the start of printing is shifted. A timing is controlled so that a second pattern is printed with printed dots, respectively, being shifted by a pattern corresponding to 720 dpi, thereby making it possible to print a plurality of dots, respectively, to be partially overlaid at the shifted positions to each other along the main scanning direction.

With respect to the aforementioned embodiments 1 and 2, the former is characterized by a construction in which dots formed by the same print elements are overlaid with each other by a plurality of times of scanning, and the latter is characterized by controlling a driving frequency or a scanning speed in a main scanning direction, thereby to enhance the density of dots. According to the construction of embodiment 1, the dots are overlaid with each other, thereby making it possible to enhance the density of dots formed, and improve visibility. Further, in a construction shown in embodiment 2, the dots formed by the same print elements so that the adjacent dots are partially overlaid with each other, thereby making it possible to improve visibility.

In the aforementioned embodiments 1 and 2, the density of dots formed along the main scanning direction becomes higher than that caused during ordinary printing operation. Further, the dots are overlaid at the same position or are partially overlaid, thereby making it possible to enhance the density of dots and improving visibility of patterns.

Embodiment 3

In addition, the method for performing printing with shifting an impact position of dot in the main scanning direction was described in embodiment 2, there is also a method for enhancing the visibility by increasing effective areas of dots through printing dots with shifting impact positions of the dots in the sub-scanning direction.

Figure 10:
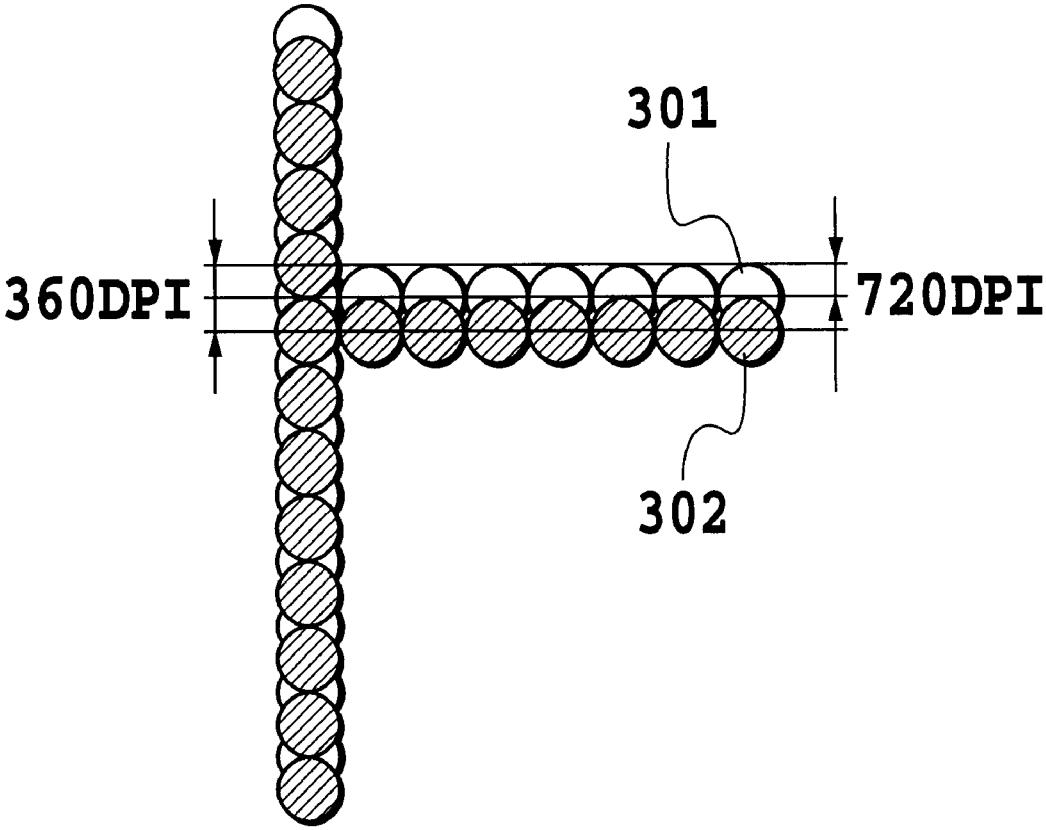
FIG. 10 is an enlarged drawing showing test pattern where impact positions of dots are shifted in the sub-scanning direction.
Figure 11:
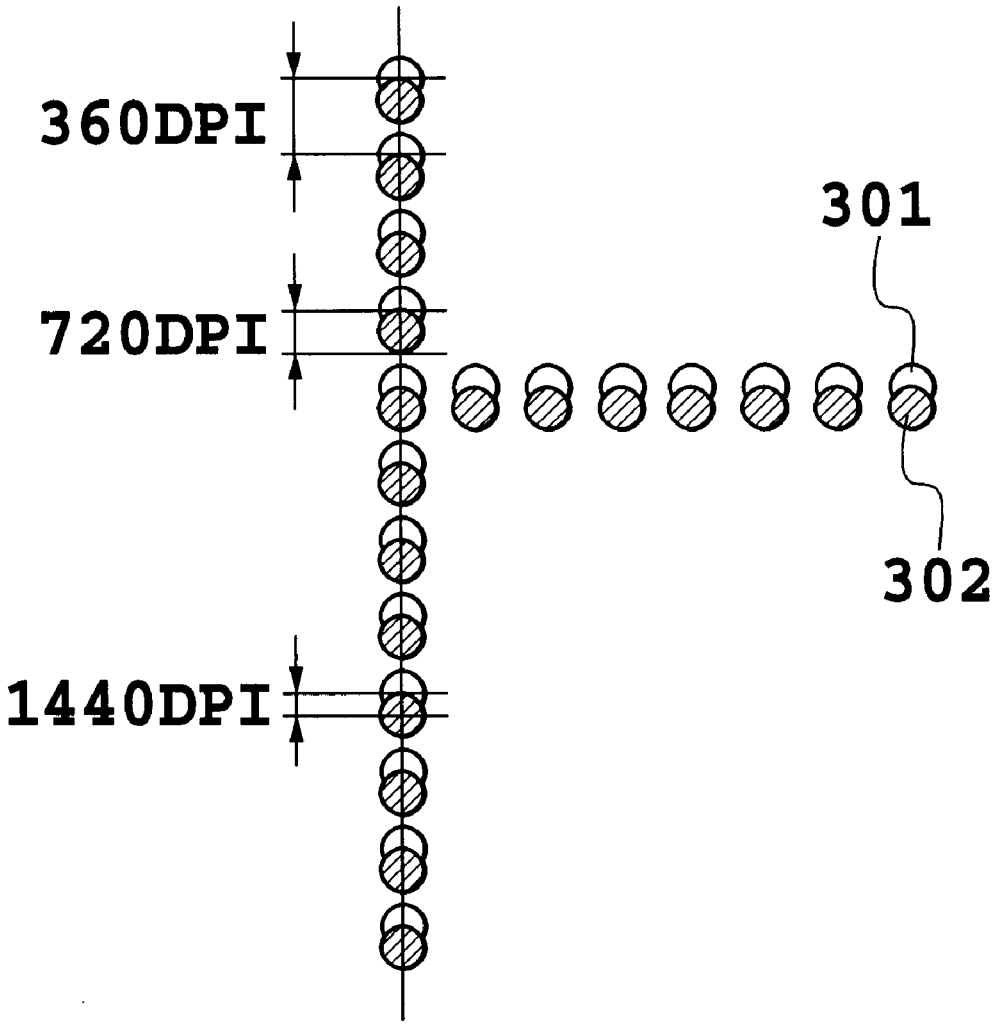
FIG. 11 is an enlarged drawing showing another example of test patterns where impact positions of dots are shifted in the sub-scanning direction.

Thus, as shown in FIGS. 10 and 11, the second 20 line, that is, a horizontal line 302 shown by hatched circles is formed after minutely feeding paper after forming the first line, that is, a horizontal line 301 shown by white circles in the drawings. It is possible to increase areas since the first line of dots and the second line of dots are overlapped by repeating minute paper feeding and printing like this. Owing to this, print in the part where dots are overlapped becomes dense. Therefore, it is possible to enhance the visibility of a desired image. Furthermore, the length of paper feed, and the frequency of repeating printing is arbitrary, and can be changed according to dot diameter and ink color.

In addition, a line of a test pattern that is printed can be in such a state that the first line of dots contact the second line of dots instead of overlapping. If dots contact, a horizontal line of the test pattern becomes dense, and hence it is possible to enhance the visibility.

In the foregoing description, there was shown an example of a plurality of dots formed from a same ejection opening being printed at the shifted positions each other along a secondary scan direction. The present invention is not limitative to this construction, and is sufficiently applicable to a construction in which a printing medium and a printing head are moved relatively to the sub-scanning direction. For example, a construction in which a mechanism capable of moving a printing head with a very short distance along the sub-scanning direction makes it possible to form a pattern as shown in FIG. 10.

According to these embodiments, there is provided a construction for relatively moving the printing medium and the printing head, including a paper feed mechanism or a mechanism for moving the printing head in the sub-scanning direction. Thus, a plurality of dots formed from the same ejection opening of the printing head can be printed at the shifted positions each other along the sub-scanning direction, and visibility of the dots corresponding to each ejection opening can be enhanced.

Embodiment 41

In this embodiment, such a method that a user can select a method between the method for overlaying a plurality of dots at the same positions as described in the first embodiment, and the method for shifting dot positions as described in the second embodiment will be described.

A user selects a test pattern printing method as shown below when the user inputs a test pattern print command in a host computer.

Figure 12:
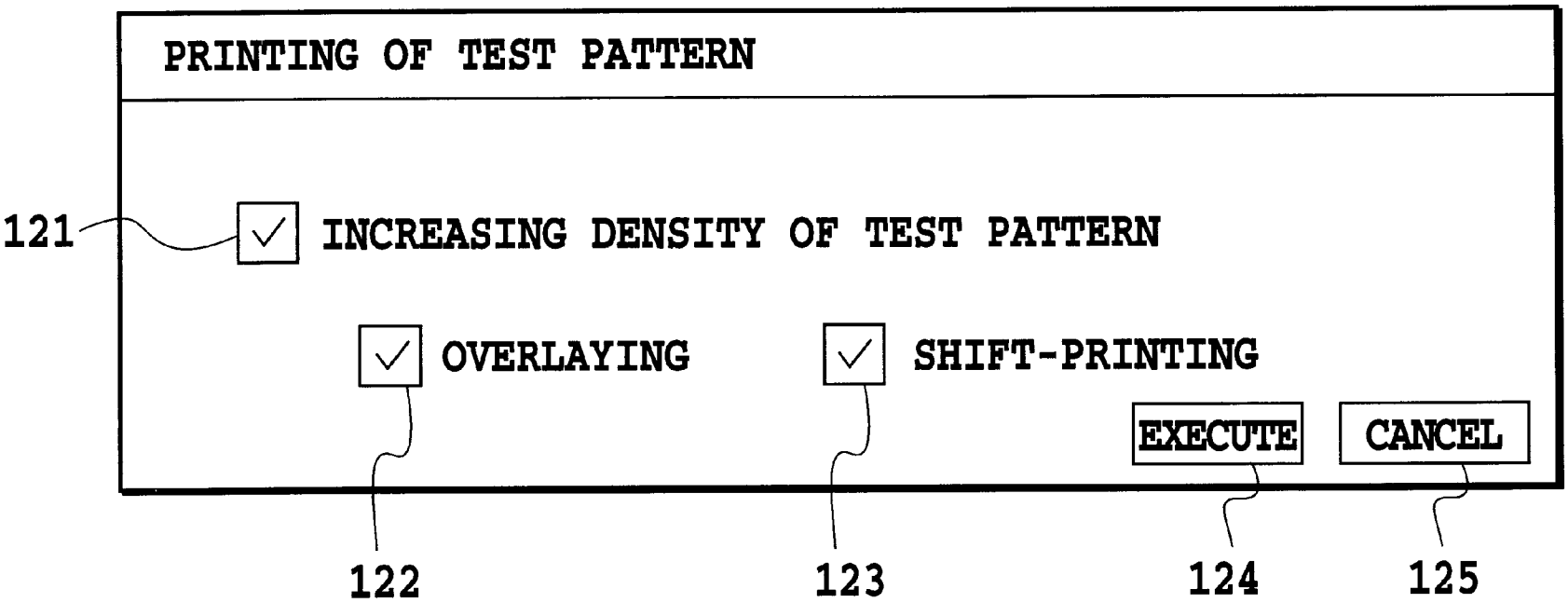
FIG. 12 is a drawing showing a test pattern print selective operation screen.

FIG. 12 is a test pattern print selective operation screen displayed on the host computer.

When the user inputs the test pattern print command, the host computer displays the test pattern print selective operation screen. At this time, the user selects "INCREASING DENSITY OF TEST PATTERN" 121 if the user wants a print result in high density. Furthermore, the user selects either "OVERLAYING" 122 or "SHIFT-PRINTING" 123 in the printing method. Then, by the user operating an EXECUTE button 124, contents selected are transmitted to a printer. If the user operates the EXECUTE button 124 without selecting the "INCREASING DENSITY OF TEST PATTERN" 121, normal test pattern printing is performed. In addition, if the user fails operation, the user can attempt selective operation from the: beginning again by pressing a CANCEL button 125.

Figure 13:
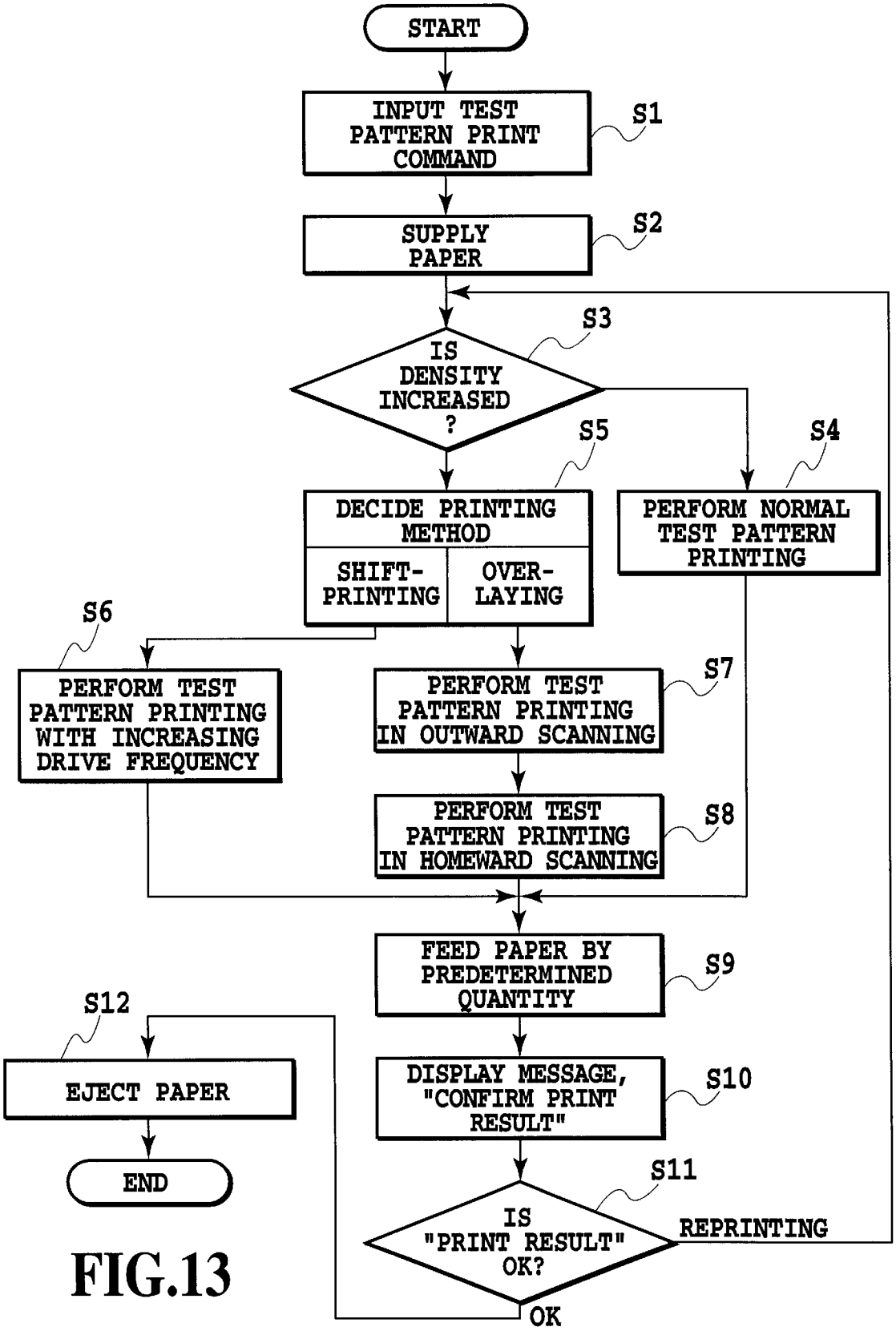
FIG. 13 is a flowchart showing processing from the input of a print command to the completion of printing.

FIG. 13 is a flowchart showing processing from the input of a print command to the completion of printing.

When the user, as described above, operates the host computer to input the test pattern print command, the host computer transmits these contents to a printer. When the printer receives the test pattern print command (step 1), the printer activates the paper supply unit 2 to supply a printing medium to a predetermined position (step 2).

Next, the printer decides whether the density of the test pattern should be increased from the contents of the test pattern print command (step 3).

If the density is not-increased, normal test pattern printing is performed (step 4).

If the density is increased, its printing method is decided from the contents of the test pattern print command (step 5).

If the printing method is the shift-printing, similarly to the second embodiment, the drive frequency is increased to shift dots in the main scanning direction, and a plurality of printing by the same ejection opening is performed (step 6).

If the printing method is the overlaying, a first printing is performed in the outward direction of the main scanning, (step 7), and the carriage is made to scan in the homeward direction when the carriage moves to an end of the printing medium. As a result, the printer overlays dots by the same ejection opening at the positions where dots are printed in the first printing (step 8).

When printing of the test pattern is completed, the printer performs paper feed by predetermined quantity (step 9). Then, the printer transmits a print completion signal to the host computer. The host computer displays a print result confirmation message on a screen for the user, the message which asks the user whether the density of this print result is sufficient (step 10). For example, the print result confirmation message, "Is the density of this print result is sufficient?" is displayed. The user selects "OK" if the user is satisfied, or the user selects "REPRINTING" if the density is insufficient. Then, this selection signal is transmitted to the printer (step 11). If the printer receives a selection command of "OK," the printer ejects the printing medium (step 12) to terminate the processing. On the other hand, if the printer receives a selection command of "REPRINTING," the process returns to step 3 to print the test pattern at a new location after paper feed.

In addition, if the user selects reprint at the time of print result confirmation, the printer can reprint the test pattern reflecting the contents of setting changes on the selective operation screen. The contents of setting changes are to increase ink ejection quantity, to increase the frequency of overlaying, or to change the drive frequency.

Furthermore, in the flowchart described above, the user performs operation on the selective operation screen of the host computer, but it can be implemented that a selective operation unit is provided in a printer and a user performs operation in the selective operation unit of the printer.

If the printing method is "SHIFT-PRINTING," the throughput of the shift-printing is higher than that of the overlaying since the shift-printing can print the test pattern only in the outward scanning direction. On the other hand, if the printing method is "OVERLAYING," it is possible to print the test pattern that is high in the density of dots, which are formed, and good in print accuracy. By providing selection processing of a printing method as described above, a user can select a printing method suitable to the application and ink color of a print head.

In addition, if the first print result is not good, it is possible to print the test pattern on the same printing medium, and hence a user need not supply a new printing medium every reprinting. Therefore, it is possible to use the printing medium effectively.

Embodiment 5

The next embodiment reads a print result with an optical sensor when a test pattern is printed in the outward scanning direction and decides according to the density of this read result whether overlaying should be performed.

The optical sensor (not shown) as well as the print head 3 is provided in the carriage 4. This optical sensor irradiates a printing medium with light, and reads an image, which is printed, through a difference of reflected light. In this embodiment, the optical sensor moves on the printing medium with synchronizing with movement of the carriage 4, reads dots which the print head 3 prints, and detects the density of the dots.

Figure 14:
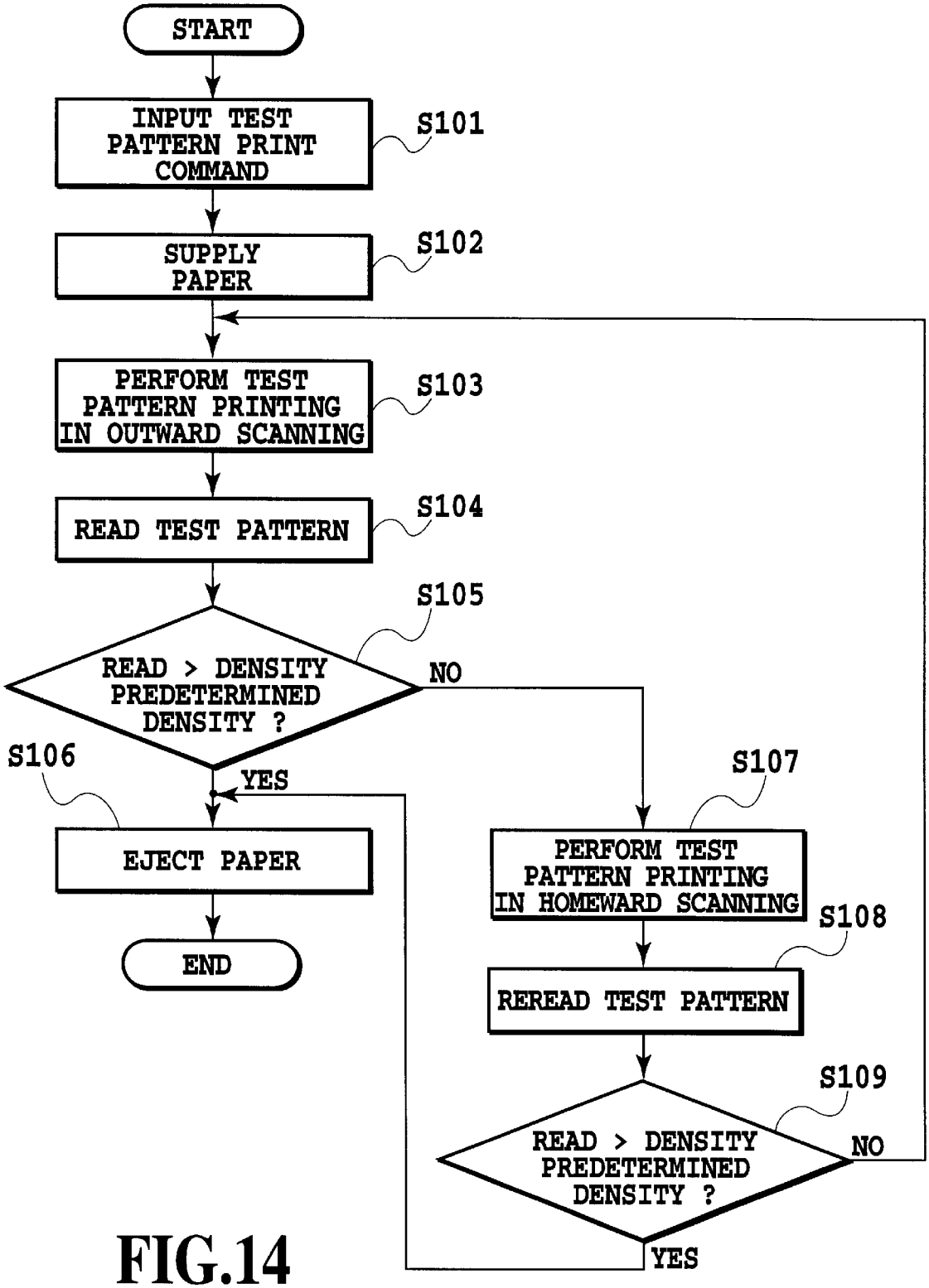
FIG. 14 is a flowchart showing another example of processing from the input of a print command to the completion of printing.

FIG. 14 is a flowchart showing processing from the input of a test pattern print command to the completion of printing.

When the test pattern print command is inputted from a host computer or an operation unit of a printer (step 101), the printer activates the paper supply unit 2 to-supply the printing medium at the predetermined location (step 102). Then, the printer moves the carriage in the outward direction and prints the test pattern with the print head 3 (step 103). At this time, the optical sensor moving across the printing medium in the outward direction reads the test pattern printed (step 104).

When the carriage moves to an end of the printing medium, the printer compares the density, which the optical sensor read, with the defined 25 density (step 105). In addition, a value that does not cause a problem of the visibility is preset as the defined density.

If the density, which is read, is higher than the defined density, it is decided that the visibility of the test pattern printed is no problem. Therefore, the printer ejects the printing medium (step 106), and terminates the print processing.

On the other hand, if the density, which is read, is lower than the defined density, it is decided that the visibility of the test pattern printed is a problem. Therefore, the printer overlays dots with the same ejection openings, as and at the same location as those in printing in the outward direction when the carriage moves in the homeward direction (step 107). At this time, the optical sensor reads the test pattern overlaid (step 108). Then, when the carriage returns to the start position, the process returns to step 105, and the printer compares the density, which the optical sensor read, with the defined density (step 109). If the density read is higher than the defined density, the printer performs the processing after step 106, and terminates the print processing. If the density read is lower than the defined density, the process returns to step 103, and the printer repeats the overlaying.

In this manner, the optical sensor reads the print result, and the printer decides according to the density, which is read, whether the overlaying should be performed. If the density read is lower than the defined density, the printer automatically performs the overlaying. Therefore, a user can always obtain an optimum print result of a test pattern without increasing the density before printing of a test pattern and without checking the print result.

In the aforementioned embodiments 1 to 3, we describe a test pattern directed to improving visibility as shown in FIG. 6, FIG. 8, FIG. 9, and FIG. 10 by way of showing an example. It is sufficient to provide a construction in which such test pattern is appropriately selected and printed according to color or concentration of ink from among conventional test patterns formed without overlaying dots or printing them at the shifted positions each other and the test patterns described in the embodiments of the present invention.

For example, in an ink jet printing apparatus in which printing heads are provided for four inks, yellow, magenta, cyan, and black inks, respectively, to print a color image, there is provided a construction in which the test patterns shown in FIG. 4 are printed for the printing heads corresponding to the cyan, magenta, and black inks, 5 and the test patterns as shown in FIG. 6, FIG. 8, FIG. 9, and FIG. 10 are printed for only the yellow ink, thereby judging an ejection failure of the printing head. In addition, in an ink jet printing apparatus for performing printing by using the cognate color of low-concentration and high concentration inks, there is provided a construction in which the test pattern as shown in FIG. 4 is printed for the high-concentration ink, and the test patterns as shown in FIG. 6, FIG. 8, FIG. 9, and FIG. 10 are printed, thereby judging an ejection failure of the printing head.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to ondemand type or continuous type ink jet recording systems, it is particularly suitable for the ondemand type apparatus. This is because the on demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated into the present invention: this structure includes heating portions disposed on bent portions in addition to a combination of the ejection orifices, liquid passages and the e :e*lec-trothermal transducers disclosed in the:above patents. Moreover, the present invention can be applied to structures disclosed in Japanese-Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, -is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

By using a test pattern printing method of the present invention, a density value of a dot pattern that is formed by color, which is difficult to be visually recognized, such as yellow and low concentration ink is increased. Therefore, it is possible to enhance the visibility of an image formed by these dot patterns.

In addition, by printing several dots with contacting with each other, the area of a dot pattern formed is enlarged, and hence it is possible to enhance the visibility of an image formed by these dot patterns.

Furthermore, by printing a test pattern by changing a drive frequency of a print head, it is possible to print dots by overlaying with or contacting the dots in one scanning pass. Hence, it is possible to increase throughput.

Moreover, it is possible that a user selects a test pattern printing method and a printer prints a test pattern with the printing method corresponding to the selection command. Therefore, the user can obtain a print result optimum for application and a print head per each color.

In addition, by providing an optical sensor as well as a print head in a carriage, sequentially reading a test pattern printed at the time of printing, and automatically performing overlaying with dots only if this density read is lower than the defined density, a user can always obtain an optimum print result of the test pattern without setting of increasing the density before printing of the test pattern and without checking the print result.

The present invention has been described in detail with respect to preferred embodiments, and it will now be apparent from the foregoing to those skilled in the art that changes and modification may be made without departing from the invention in its broader aspect, and it is the invention, therefore, in the apparent claims to cover all such changes and modification as fall within the true spirit of the invention.

What is claimed is:

1. A test pattern printing method for printing a test pattern on a printing medium with a printing apparatus that uses a plurality of print heads for forming dots of a plurality of colors, respectively, on the printing medium, each of the plurality of print heads being provided with a print element to form the dots, said method comprising:

a main scanning step of scanning the plurality of print heads along a main scanning direction; and a test pattern printing step of selectively driving the print elements of the plurality of print heads, thereby to form dots and print a test pattern, wherein said test pattern printing step prints the test pattern for each selected print element, and forms a predetermined number of dots along the main-scanning direction using the selected print element for each test pattern, where the selected print element is changed for each test pattern, and where a density of dots formed along the main scanning direction of a predetermined color among the plurality of colors per unit area formed by one print element is higher than a density of dots formed along the main scanning direction of other colors per unit area formed by other print elements so that an optical density of dots of the predetermined color is increased to print the test pattern.

2. A test pattern printing method according to claim 1, wherein a plurality of dots of the predetermined color formed by selected print elements in said pattern printing step are overlaid on each other to print the test pattern.

3. A test pattern printing method according to claim 2, wherein a plurality of dots of the predetermined color formed by selected print elements in said pattern printing step are overlaid on each other through a plurality of scannings, respectively, in the main scanning direction.

4. A test pattern printing method according to claim 3, wherein a plurality of print elements are driven in said pattern printing step so that the dots of the predetermined color are formed at a same position through a plurality of scannings, respectively, in the main scanning direction.

5. A test pattern printing method according to claim 2, wherein each selected print element is driven in said pattern printing step during a main scanning in the main scanning direction, thereby to cause a plurality of dots of the predetermined color formed by selected print elements to at least partially overlay each other.

6. A test pattern printing method according to claim 5, wherein the driving frequency of each selected print element in said pattern printing step, during scanning in the main scanning direction, is higher than a driving frequency caused during image printing operation.

7. A test pattern printing method according to claim 2, wherein a scanning speed in the main scanning direction is controlled in said main scanning step to cause a plurality of dots of the predetermined color formed by selected print elements to at least partially overlay each other.

8. A test pattern printing method according to claim 7, wherein the scanning speed in the main scanning direction in said pattern printing step is lower than a scanning speed caused in image printing operation.

9. A test pattern printing method according to claim 1, further comprising:

a sub-scanning step for relatively moving the plurality of print heads and the printing medium in a sub-scanning direction orthogonal to the main scanning direction, wherein said pattern printing step comprises a first dot forming step of forming dots in a first main scanning in said main scanning step; and a second dot forming step of forming dots in a main scanning in said main scanning step following a relative movement in a sub-scanning direction in said sub-scanning step, the dots of the predetermined color formed by selected print elements in said first and second dot forming steps being brought into contact with each other along the sub-scanning direction.

10. A test pattern printing method according to claim 9, wherein the printing medium is carried in the sub-scanning direction in said sub-scanning step.

11. A test pattern printing method according to claim 9, wherein the print head is moved in the sub-scanning direction in said sub-scanning step.

12. A test pattern printing method according to claim 1, further comprising the steps of:

optically reading the density of a pattern printed in said pattern printing step; and executing pattern forming again if the density read in said reading step is less than a predetermined density.

13. A test pattern printing method according to claim 1, wherein the pattern formed in said pattern printing step is a pattern caused by alternately printing one or more lines in a direction different from an arranging direction of the print elements, that are caused by printing on a printing medium by a predetermined length while the plurality of print heads are scanned in the main direction relative to the printing medium, and lines in a direction identical to the arranging direction that are composed of a plurality of dots formed by a plurality of print elements, respectively.

14. A test pattern printing method according to claim 1, wherein the pattern is printed in said pattern printing step by alternately performing the steps of driving predetermined print elements selected during scanning in the main scanning direction to print one or more lines by predetermined lengths in a direction different from the arranging direction of the print elements, and printing lines in a direction identical to the arranging direction composed of a plurality of dots formed by a plurality of print elements, respectively.

15. A test pattern printing method for printing plurality of test patterns on a printing medium with a printing apparatus that uses a print head where a plurality of print elements for forming dots on the printing medium are arranged, said method comprising:

a scanning step of scanning the print head relative to the printing medium in a direction different from a direction of an arrangement of the plurality of print elements; and a test pattern printing step of selectively driving the plurality of print elements of the print head during scanning in said scanning step, thereby to print a test pattern, said test pattern printing step repeating the steps of: selecting predetermined print elements of the print head, where the predetermined print elements include some but not all of the plurality of print elements arranged on the print head; and driving the selected print elements to form one or more lines along the scanning direction, wherein the selected predetermined print elements of the print head are changed when said selecting and driving steps are completed, wherein said test pattern printing step further comprises selecting the test pattern to be printed from a plurality of test patterns, which are different from each other in a density of dots formed along the scanning direction, according to a predetermined condition.

16. A test pattern printing method according to claim 15, wherein a test pattern to be printed can be selectively changed from among the plurality of test patterns according to a user preference.

17. A printing apparatus comprising:

main scanning means for relatively scanning along a main-scanning direction a plurality of print heads for forming dots of a plurality of colors, respectively, on a printing medium, each of the plurality of print heads being provided with a print element to form the dots, and driving the print elements of the plurality of print heads during scanning by said main scanning means, thereby to print an image on the printing medium;

test pattern printing means for selectively driving the print elements of the plurality of print heads during scanning by said main scanning means, thereby to print a plurality of test patterns, wherein the plurality of test patterns include one or more lines printed along the main-scanning direction by driving a selected, predetermined print element from among the print elements of the plurality of print heads, the one or more lines being composed of a plurality of dots formed by the selected print element, where the selected print element is changed for each test pattern; and controlling means for controlling a density of the plurality of dots in a manner such that the density of the dots of a predetermined color among the plurality of colors per unit area formed by one print element in the plurality of test patterns is higher than a density of dots of other colors per unit area formed by other print elements so that an optical density of the dots of the predetermined color is increased to print the plurality of test patterns.

18. A printing apparatus according to claim 17, wherein said controlling means controls a plurality of dots of the predetermined color, the dots constituting one or more lines along the main scanning direction, so that the dots overlay each other.

19. A printing apparatus according to claim 18, wherein said controlling means controls dot forming so that a plurality of dots of the predetermined color overlay each other by printing a test pattern through a plurality of times of scanning the plurality of print heads by said main scanning means.

20. A printing apparatus according to claim 19, wherein said controlling means controls driving of a plurality of print elements so that dots of the predetermined color are formed at the same position, during a plurality of times of scanning, respectively, in the main scanning direction.

21. A printing apparatus according to claim 17, wherein, when the test pattern of the predetermined color is printed, said controlling means controls driving of each print element during a main scanning in the main scanning direction, thereby to cause a plurality of dots formed by selected print elements to at least partially overlay each other.

22. A printing apparatus according to claim 21, wherein said controlling means ensures that, when the test pattern of the predetermined color is printed, the driving frequency of each print element during scanning in the main scanning direction, is higher than a driving frequency caused during image printing operation.

23. A printing apparatus according to claim 18, wherein said controlling means controls a scanning speed of the plurality of print heads in a main scanning direction by said main scanning means, thereby to cause a plurality of dots of the predetermined color formed by selected print elements to at least partially overlay each other.

24. A printing apparatus according to claim 23, wherein said controlling means ensures that, when the test pattern of the predetermined color is printed, the scanning speed of the plurality of print heads in the main scanning direction, is lower than a scanning speed caused during image printing operation.

25. A printing apparatus according to claim 17, further comprising sub-scanning means for relatively moving the plurality of print heads and the printing medium in a sub-scanning direction orthogonal to the main scanning direction, wherein said controlling means controls printing of a pattern of the predetermined color during first main scanning caused by said main scanning means, and printing of the pattern of the predetermined color during main scanning caused by said main scanning means following relative movement in the sub-scanning direction caused by said sub-scanning means, thereby to bring dots of the predetermined color formed by selected print elements into contact with each other along the sub-scanning direction.

26. A printing apparatus according to claim 25, wherein said sub-scanning means includes carrying means for carrying the printing medium in the sub-scanning direction.

27. A printing apparatus according to claim 25, wherein said sub-scanning means includes means for moving the plurality of print heads in the sub-scanning direction.

28. A printing apparatus according to claim 17, further comprising reading means capable of optically reading the density of a printed test pattern on the printing medium, wherein, if the density of the read test pattern read by said reading means is less than a predetermined density, said controlling means controls said test pattern printing means so that the test pattern is printed again.

29. A printing apparatus according to claim 17, wherein the plurality of print heads serve as ink jet heads having ejection openings for ejecting an ink, and wherein when driving the print elements, the ink is ejected from the ejection openings to perform printing.

30. A printing apparatus according to claim 28, wherein the print elements arranged at the plurality of print heads serve as electrothermal conversion elements for imparting thermal energy to inks, the plurality of print heads ejecting ink from ejection openings by using the thermal energy.

31. A printing apparatus comprising:

main scanning means for relatively scanning along a main-scanning direction a print head where a plurality of print elements for forming dots on a printing medium are arranged, and driving the plurality of print elements of the print head during scanning caused by said main scanning means, thereby printing an image on the printing medium;

test pattern printing means for selectively driving the plurality of print elements of the print head during scanning caused by said main scanning means, thereby to print a test pattern, wherein said test pattern printing means repeatedly selects predetermined print elements of the print head, where the predetermined print elements include some but not all of the plurality of print elements arranged on the print head, and drives the selected print elements to form one or more lines along the main-scanning direction, wherein the selected predetermined print elements are changed after said test pattern printing means has completed selecting and driving the predetermined print elements; and controlling means for selecting the test pattern to be printed by said test pattern printing means from a plurality of test patterns, which are different from each other in a density of dots formed along the main scanning direction, according to a predetermined condition.

32. A printing apparatus according to claim 31, wherein the plurality of test patterns can be selectively changed according to a user preference.

33. A printing apparatus according to claim 31, wherein the print head is an ink jet head having an ejection opening for ejecting an ink and when driving the print elements, ink is ejected from the ejection opening to perform printing.

34. A printing apparatus according to claim 33, wherein said printing apparatus has a plurality of print heads corresponding to different inks, respectively, and said controlling means changes the test pattern recorded by the print heads based on the inks corresponding to the print heads.

35. A printing apparatus according to claim 34, wherein, if the test patterns are printed by a print head corresponding to relatively low concentration inks, said controlling means controls dots so as to print at least one test pattern with relatively high density in a plurality of dots constituting one or more lines along the scanning direction, of the plurality of test patterns.

36. A printing apparatus according to claim 33, wherein the plurality of print elements arranged at the print head serve as electrothermal conversion elements for imparting thermal energy to inks, the print head ejecting an ink from an ejection opening from the thermal energy.

* * * * *

UNITED STATES PATENT AND TRADEMARK OFFICE

CERTIFICATE OF CORRECTION

PATENT NO. : 6,726,302 B2
DATED : April 27, 2004
INVENTOR(S) : Kaneji Yamada

It is certified that error appears in the above-identified patent and that said Letters Patent is hereby corrected as shown below:

Column 1,
Line 59, “(1997.)” should read -- (1997), --.

Column 4,
Line 6, “5” should be deleted.

Column 12,
Line 19, “e :e*lec-trothmeral” should read -- electrothermal -- and “the:above” should read -- the above --.

Column 16,
Line 25, “include” should read -- includes --.
Line 47, “overlay” should read -- overlays --.

Column 18,
Line 4, “are” should read -- is --.
Line 47, “serve” should read -- serves --.

Signed and Sealed this

Twenty-third Day of November, 2004

JON W. DUDAS
*Director of the United States Patent and Trademark Office*